US008751236B1

(12) United States Patent
Fructuoso et al.

(10) Patent No.: US 8,751,236 B1
(45) Date of Patent: Jun. 10, 2014

(54) DEVICES AND METHODS FOR SPEECH UNIT REDUCTION IN TEXT-TO-SPEECH SYNTHESIS SYSTEMS

(71) Applicant: Google Inc., Mountain View, CA (US)

(72) Inventors: Javier Gonzalvo Fructuoso, London (GB); Alexander Gutkin, Cambridge (GB); Ioannis Agiomyrgiannakis, London (GB)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/061,118

(22) Filed: Oct. 23, 2013

(51) Int. Cl.
*G10L 13/00* (2006.01)
*G10L 13/06* (2013.01)

(52) U.S. Cl.
USPC ..... 704/258; 704/266

(58) Field of Classification Search
CPC ..... G10L 13/07; G10L 13/06; G10L 13/04; G10L 13/08; G10L 13/033
USPC ..... 704/258–269
See application file for complete search history.

(56) References Cited

U.S. PATENT DOCUMENTS

| | | | | |
|---|---|---|---|---|
| 5,740,320 | A * | 4/1998 | Itoh | 704/267 |
| 5,913,193 | A | 6/1999 | Huang et al. | |
| 6,988,069 | B2 | 1/2006 | Phillips | |
| 7,369,994 | B1 | 5/2008 | Beutnagel et al. | |
| 8,024,193 | B2 | 9/2011 | Bellegarda | |
| 8,412,528 | B2 | 4/2013 | Fischer et al. | |
| 2004/0093213 | A1* | 5/2004 | Conkie | 704/258 |
| 2006/0069566 | A1* | 3/2006 | Fukada et al. | 704/260 |
| 2011/0246200 | A1* | 10/2011 | Song et al. | 704/260 |

OTHER PUBLICATIONS

A. Black and P. Taylor, "Automatically Clustering Similar Units for Unit Selection in Speech Synthesis", Eurospeech97, vol. 2, pp. 601-604, Rhodes, Greece, 1997.

P. Tsaikoulis, A. Chalamandaris, S. Karabetsos, and S. Raptis, "A Statistical Method for Database Reduction for Embedded Unit Selection Speech Synthesis", ICASSP 2008, pp. 4601-4604.

* cited by examiner

*Primary Examiner* — Samuel G Neway
(74) *Attorney, Agent, or Firm* — McDonnell Boehnen Hulbert & Berghoff LLP

(57) ABSTRACT

A device may receive a plurality of speech sounds that are indicative of pronunciations of a first linguistic term. The device may determine concatenation features of the plurality of speech sounds. The concatenation features may be indicative of an acoustic transition between a first speech sound and a second speech sound when the first speech sound and the second speech sound are concatenated. The first speech sound may be included in the plurality of speech sounds and the second speech sound may be indicative of a pronunciation of a second linguistic term. The device may cluster the plurality of speech sounds into one or more clusters based on the concatenation features. The device may provide a representative speech sound of the given cluster as the first speech sound when the first speech sound and the second speech sound are concatenated.

20 Claims, 9 Drawing Sheets

DEVICES AND METHODS FOR SPEECH UNIT REDUCTION IN TEXT-TO-SPEECH SYNTHESIS SYSTEMS

BACKGROUND

Unless otherwise indicated herein, the materials described in this section are not prior art to the claims in this application and are not admitted to be prior art by inclusion in this section.

A text-to-speech system (TTS) may be employed to generate synthetic speech based on text. Many example TTS systems exist. A first example TTS system may concatenate one or more recorded speech units to generate synthetic speech. A second example TTS system may concatenate one or more statistical models of speech to generate synthetic speech. A third example TTS system may concatenate recorded speech units with statistical models of speech to generate synthetic speech. In this regard, the third example TTS system may be referred to as a hybrid TTS system.

SUMMARY

In one example, a method is provided that comprises receiving a plurality of speech sounds that are indicative of pronunciations of a first linguistic term at a device. The first linguistic term may include a representation of one or more phonemes. The method further comprises determining concatenation features of the plurality of speech sounds of the first linguistic term by the device. The concatenation features may be indicative of an acoustic transition between a first speech sound and a second speech sound when the first speech sound and the second speech sound are concatenated. The first speech sound may be included in the plurality of speech sounds of the first linguistic term. The second speech sound may be indicative of a pronunciation of a second linguistic term. The method further comprises clustering the plurality of speech sounds into one or more clusters based on the concatenation features. A given cluster may include one or more speech sounds of the plurality of speech sounds that have given concatenation features that are related by a clustering metric. The method further comprises providing a representative speech sound of the given cluster as the first speech sound when the first speech sound and the second speech sound are concatenated based on a determination that the first speech sound has the given concatenation features represented in the given cluster.

In another example, a computer readable medium is provided. The computer readable medium may have instructions stored therein that when executed by a device cause the device to perform functions. The functions comprise receiving a plurality of speech sounds that are indicative of pronunciations of a first linguistic term at the device. The first linguistic term may include a representation of one or more phonemes. The functions further comprise determining concatenation features of the plurality of speech sounds of the first linguistic term by the device. The concatenation features may be indicative of an acoustic transition between a first speech sound and a second speech sound when the first speech sound and the second speech sound are concatenated. The first speech sound may be included in the plurality of speech sounds of the first linguistic term. The second speech sound may be indicative of a pronunciation of a second linguistic term. The functions further comprise clustering the plurality of speech sounds into one or more clusters based on the concatenation features. A given cluster may include one or more speech sounds of the plurality of speech sounds that have given concatenation features that are related by a clustering metric. The functions further comprise providing a representative speech sound of the given cluster as the first speech sound when the first speech sound and the second speech sound are concatenated based on a determination that the first speech sound has the given concatenation features represented in the given cluster.

In yet another example, a device is provided that comprises one or more processors and data storage configured to store instructions executable by the one or more processors. The instructions may cause the device to receive a plurality of speech sounds that are indicative of pronunciations of a first linguistic term. The first linguistic term may include a representation of one or more phonemes. The instructions may further cause the device to determine concatenation features of the plurality of speech sounds of the first linguistic term. The concatenation features may be indicative of an acoustic transition between a first speech sound and a second speech sound when the first speech sound and the second speech sound are concatenated. The first speech sound may be included in the plurality of speech sounds of the first linguistic term. The second speech sound may be indicative of a pronunciation of a second linguistic term. The instructions may further cause the device to cluster the plurality of speech sounds into one or more clusters based on the concatenation features. A given cluster may include one or more speech sounds of the plurality of speech sounds that have given concatenation features that are related by a clustering metric. The instructions may further cause the device to provide a representative speech sound of the given cluster as the first speech sound when the first speech sound and the second speech sound are concatenated based on a determination that the first speech sound has the given concatenation features represented in the given cluster.

These as well as other aspects, advantages, and alternatives, will become apparent to those of ordinary skill in the art by reading the following detailed description, with reference where appropriate to the accompanying figures.

DETAILED DESCRIPTION

Figure 1:
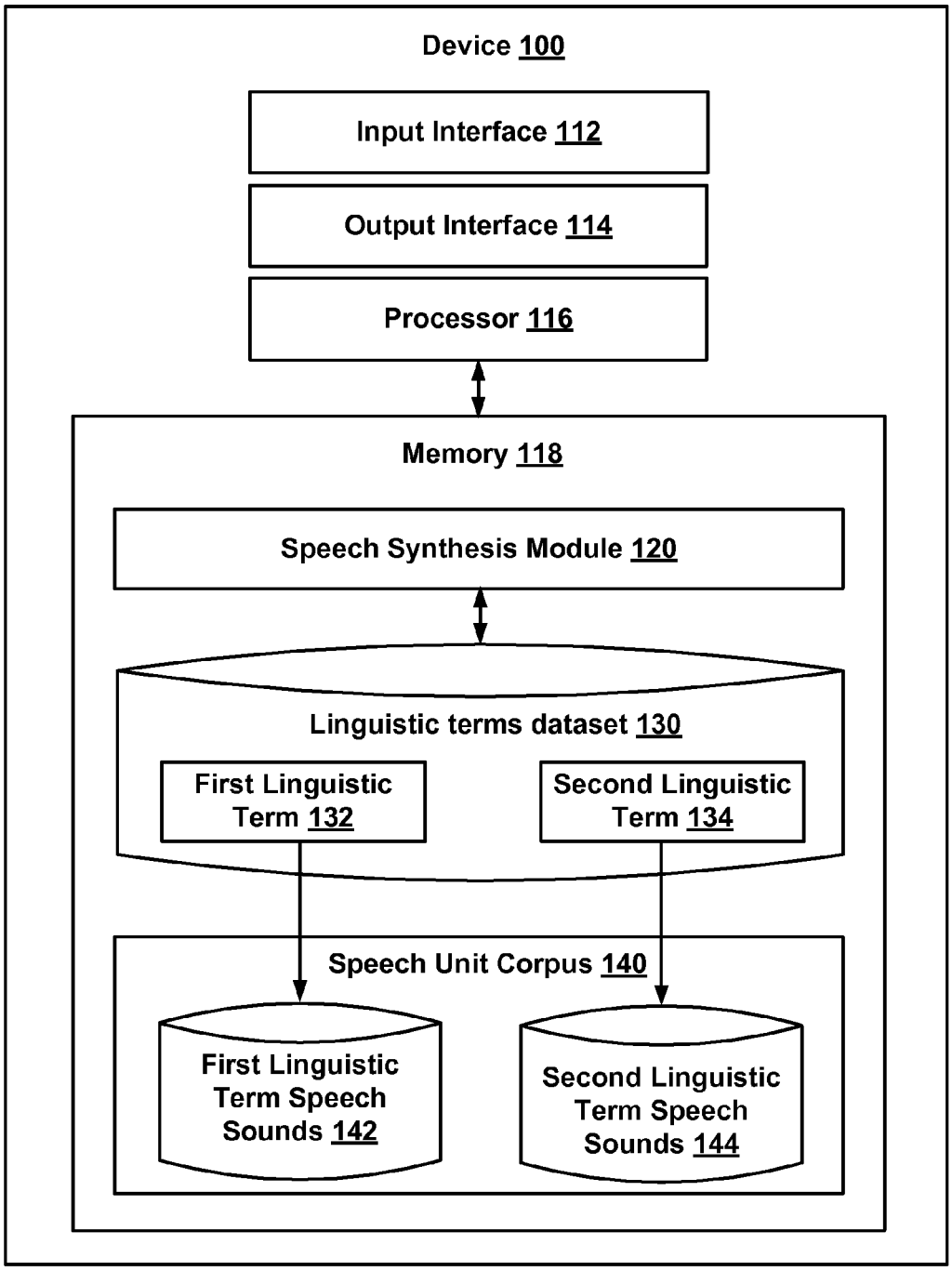
FIG. 1 illustrates an example speech synthesis device, in accordance with at least some embodiments described herein.

The following detailed description describes various features and functions of the disclosed systems and methods with reference to the accompanying figures. In the figures, similar symbols identify similar components, unless context dictates otherwise. The illustrative system, device and method embodiments described herein are not meant to be limiting. It may be readily understood by those skilled in the art that certain aspects of the disclosed systems, devices and methods can be arranged and combined in a wide variety of different configurations, all of which are contemplated herein.

Text-to-speech synthesis systems (TTS) may be deployed in various environments to provide speech-based user interfaces for example. Some of these environments include residences, businesses, vehicles, etc.

In some examples, TTS may provide audio information from devices such as large appliances, (e.g., ovens, refrigerators, dishwashers, washers and dryers), small appliances (e.g., toasters, thermostats, coffee makers, microwave ovens), media devices (e.g., stereos, televisions, digital video recorders, digital video players), communication devices (e.g., cellular phones, personal digital assistants), as well as doors, curtains, navigation systems, and so on. For example, a TTS in a navigation system may obtain text that includes directions to an address, and then guide the user of the navigation system to the address by generating audio that corresponds to the text with the directions.

In some examples, the TTS may generate synthesized audio that corresponds to the text by concatenating speech sounds that correspond to linguistic terms that make up the text. For example, a first linguistic term may correspond to the letter "c" in the word "cat." The TTS, for example, may concatenate a first speech sound that corresponds to the letter "c" with a second speech sound that corresponds to the letter "a" and a third speech sound that corresponds to the letter "t" to generate synthetic audio for a pronunciation of the word "cat." In some examples, the first linguistic term may correspond to more than one letter. For example, the first linguistic term may correspond to the letters "ca" in the word "cat", and the first speech sound may correspond to a pronunciation of the letters "ca."

In some examples, the TTS may obtain a plurality of speech sounds that correspond to the first linguistic term, and select the first speech sound from the plurality of speech sounds based on various matching criteria. For example, the TTS may receive the plurality of speech sounds that correspond to the letters "ca," and then select the first speech sound that matches a desired context of the letters "ca" in the word "cat."

In some examples, the matching criteria may include minimizing a target cost and a join cost of the match. In some examples, the target cost may be indicative of disparity between the first speech sound and the first linguistic term. For example, speech sounds that correspond to pronunciations of the letters "ka," "pa," and "ta" may be assigned various target costs when matched with the first linguistic term "ca" in the context of the word "cat." Thus, for example, the TTS may select the first speech sound that minimizes the target cost (e.g., select "ka" in the example above). In some examples, speech sounds that correspond to pronunciation of the letters "ca" may have a target cost of zero.

In some examples, the join cost may be indicative of disparity between concatenation features in the first speech sound (e.g., pronunciation of letters "ca") and concatenation features in the second speech sound (e.g., pronunciation of letter "t") associated with a second linguistic term. The concatenation features may pertain to an acoustic transition between the first speech sound and the second speech sound when the first speech sound and the second speech sound are concatenated. For example, a first concatenation feature of the first speech sound may include a last fundamental frequency value (F0) (e.g., pitch of ending portion of the first speech sound), and a second concatenation feature of the second speech sound may include a first F0 (e.g., pitch of beginning portion of the second speech sound). In this example, the TTS may minimize the join cost by selecting the first speech sound from the plurality of speech sounds that minimizes the difference between the first concatenation feature and the second concatenation feature (e.g., minimize difference in pitch). Thus, in some examples, minimizing the join cost may optimize prosody of the synthesized audio generated by the TTS and reduce discontinuity between concatenated speech sounds.

In some examples, the TTS may access a corpus of speech sounds (e.g., database or audio files stored in memory) to obtain the plurality of speech sounds for each linguistic term in the input text. Thus, in some examples, it may be desirable to have a large corpus of speech sounds to allow the TTS more options to minimize the target cost and the join cost of the speech sounds selected for concatenation. However, in some examples, the size of the corpus may be limited. For example, the TTS may be included in a computing device with limited memory resources (e.g., smartphone).

Within examples, methods, devices and systems are provided for reducing the size of such corpus by reducing quantity of the speech sounds while maintaining sparsity of the speech sounds from the join cost point of view. For example, a device may be configured to receive a plurality of speech sounds that are associated with a first linguistic term. The device may then be configured to determine concatenation features of the plurality of speech sounds. The device may then be configured to cluster the plurality of speech sounds based on the concatenation features into one or more clusters such that a given cluster includes one or more speech sounds that have given concatenation features that are related by a clustering metric. Thus, for example, when a TTS requests a first speech sound having concatenation features represented in the given cluster, the device may then be configured to provide a representative speech sound of the given cluster as the first speech sound. In some examples, the device may be further configured to reduce the size of the speech corpus by removing speech sounds associated with the first linguistic term other than representative speech sounds of the one or more clusters. Additionally, in some examples, the device may be configured to repeat the previous process for speech sounds in the corpus that are associated with other linguistic terms to further reduce the size of the corpus.

Referring now to the figures, FIG. 1 illustrates an example speech synthesis device 100, in accordance with at least some embodiments described herein. The device 100 includes an input interface 112, an output interface 114, a processor 116, and a memory 118.

The device 110 may comprise a computing device such as a smart phone, digital assistant, digital electronic device, body-mounted computing device, personal computer, or any other computing device configured to execute instructions included in the memory 118 to operate the device 110. Although not illustrated in FIG. 1, the device 110 may include additional components, such as a camera, an antenna, or any other physical component configured, based on instructions in the memory 118 executable by the processor 116, to operate the device 110. The processor 116 included in the device 110 may comprise one or more processors configured to execute instructions in the memory 118 to operate the device 110.

The input interface 112 may include an input device such as a keyboard, touch-screen display, mouse, or any other component configured to provide an input signal comprising text content to the processor 116. The output interface 114 may include an audio output device, such as a speaker, headphone, or any other component configured to receive an output audio signal from the processor 116, and output sounds that may indicate speech content based on the output audio signal.

Additionally or alternatively, the input interface 112 and/or the output interface 114 may include network interface components configured to, respectively, receive and/or transmit the input signal and/or the output signal described above. For example, an external computing device may provide the input signal to the input interface 112 via a communication medium such as Wifi, WiMAX, Ethernet, Universal Serial Bus (USB), or any other wired or wireless medium. Similarly, for example, the external computing device may receive the output signal from the output interface 114 via the communication medium described above.

The memory 118 may include one or more memories (e.g., flash memory, Random Access Memory (RAM), solid state drive, disk drive, etc.) that include software components configured to provide instructions executable by the processor 116 pertaining to the operation of the device 110. Although illustrated in FIG. 1 that the memory 118 is physically included in the device 110, in some examples, the memory 118 or some components included thereon may be physically stored on a remote computing device. For example, some of the software components in the memory 118 may be stored on a remote server accessible by the device 110.

The memory 118 may include a speech synthesis module 120 configured to provide instructions executable by the processor 116 to cause the device 110 to generate a synthetic speech audio signal via the output interface 114. The speech synthesis module 120 may comprise, for example, a software component such as an application programming interface (API), dynamically-linked library (DLL), or any other software component configured to provide the instructions described above to the processor 116. Further, in some examples, the speech synthesis module 120 may receive text or a representation thereof via the input interface 112 and determine the synthetic speech audio signal corresponding to the received text.

To facilitate the synthesis described above, the speech synthesis module 120 may utilize linguistic terms dataset 130 stored in the memory 118. The linguistic terms dataset 130 may include a plurality of linguistic terms such as first linguistic term 132 and second linguistic term 134. In some examples, a linguistic term may correspond to a portion of the input text and may be indicative of a representation of the portion that includes one or more phonemes. For example, the text received via the input interface 112 may be represented by a phonemic representation (e.g., transcription). Within some examples, the term "phonemic representation" may refer to the text presented as one or more phonemes indicative of a pronunciation of the text, perhaps by representing the text as a sequence of at least one phoneme. The at least one phoneme may be determined using an algorithm, method, and/or process suitable for processing the text, in order to determine the phonemic representation.

In some examples, a phoneme may be considered to be a smallest segment (or a small segment) of an utterance that encompasses a meaningful contrast with other segments of utterances. Thus, a word typically includes one or more phonemes. For example, phonemes may be thought of as utterances of letters; however, some phonemes may present multiple letters. An example phonemic representation for the English language pronunciation of the word "cat" may be /k/ /ae/ /t/, including the phonemes /k/, /ae/, and /t/ from the English language. In another example, the phonemic representation for the word "dog" in the English language may be /d/ /aw/ /g/, including the phonemes /d/, /aw/, and /g/ from the English language.

Different phonemic alphabets exist, and these alphabets may have different textual representations for the various phonemes therein. For example, the letter "a" in the English language may be represented by the phoneme /ae/ for the sound in "cat," by the phoneme /ey/ for the sound in "ate," and by the phoneme /ah/ for the sound in "beta." Other phonemic representations are possible. As an example, in the English language, common phonemic alphabets contain about 40 distinct phonemes. In some examples, a sequence of two phonemes (e.g., /k/ /ae/) may be described as a diphone. In this example, a first half of the diphone may correspond to a first phoneme of the two phonemes (e.g., /k/), and a second half of the diphone may correspond to a second phoneme of the two phonemes (e.g., /ae/). Similarly, in some examples, a sequence of three phonemes may be described as a triphone.

In some examples, the first linguistic term 132 and/or the second linguistic term 134 may correspond to one or more phonemes. For example, the first linguistic term 132 may correspond to the phoneme /k/ and the second linguistic term 134 may correspond to the phoneme /ae/. Thus, for example, the speech synthesis module 120 may associate an input text for the word "cat" to the first linguistic term 132, the second linguistic term 134, and a third linguistic term (not shown in FIG. 1) that corresponds to the phoneme /t/. Alternatively, in some examples, the first linguistic term 132 may correspond to the diphone that corresponds to the two phonemes /k/ /ae/, and the second linguistic term 134 may correspond to the phoneme /t/. In this example, the speech synthesis module 120 may associate the input text "cat" to the first linguistic term 132 (/k/ /ae/) and the second linguistic term 134 (/t/). Although illustrated in FIG. 1 that the linguistic terms dataset 130 includes only two linguistic terms, in some examples, the linguistic terms dataset 130 may include more linguistic terms. For example, the linguistic terms dataset 130 may include a linguistic term for every phoneme in the English language.

Speech unit corpus 140 may include a plurality of speech sounds such as first linguistic term speech sounds 142 and second linguistic term speech sounds 144. In some examples, the speech unit corpus 140 may comprise a database that includes the first linguistic term speech sounds 142 and/or the second linguistic term speech sounds 144 along with identifiers that associate speech sounds to their respective linguistic term. In other examples, the speech unit corpus 140 may comprise a plurality of audio files for which the first linguistic term 132 and/or the second linguistic term 134 have identifiers. In some examples, each linguistic term in the linguistic term dataset 130 may be associated with a plurality of speech sounds included in the speech unit corpus 140. For example, as illustrated in FIG. 1, the first linguistic term 132 may be associated with the first linguistic term speech sounds 142, and the second linguistic term 134 may be associated with the second linguistic term speech sounds 144.

Although illustrated in FIG. 1 that the speech unit corpus 140 includes only two sets of speech sounds, in some examples, the speech unit corpus 140 may include more sets of speech sounds. For example, the speech unit corpus 140 may include a plurality of speech sounds associated with each linguistic term in the linguistic terms dataset 130.

The generation of the first linguistic term speech sounds 142 and the second linguistic term speech sounds 144 in the speech unit corpus 140 may be performed using various methods. For example, the device 110 or any other computing device may receive configuration data that includes text such as "the camera can take an image" along with audio recitation of the text. In this example, the device 110 may then extract audio from the recitation for the first linguistic term 132 to correspond to the letters "ca" in the word "camera" and the word "can" and store the extracted audio as two speech sounds in the first linguistic term speech sounds 132. Further, in this example, the device 110 may extract audio for the second linguistic term 134 that corresponds to the letter "t" and store the extracted audio as one speech sound in the second linguistic term speech sounds 144. Further, in this example, the device 110 may then generate synthetic audio for the word "cat" by selecting one of the speech sounds in the first linguistic term speech sounds 142 and concatenating the selected speech sound with the one speech sound in the second linguistic term speech sounds 144. Other methods for generating the speech unit corpus 140 are possible such as analyzing audio data from more than one speaker for example.

In some examples, the implementation of the speech synthesis module 120 to generate the synthetic audio signal may include methods such as concatenative speech unit synthesis. In one example of concatenative speech unit synthesis, the speech synthesis module 120 may determine a hidden Markov model (HMM) chain that corresponds to the phonemic representation of the input text. For example, the linguistic terms dataset 130 may be implemented as an HMM model dataset where the first linguistic term 130 corresponds to an HMM. For example, the HMM may model a system such as a Markov process with unobserved (i.e., hidden) states. Each HMM state may be represented as a multivariate Gaussian distribution that characterizes statistical behavior of the state. For example, the Gaussian distribution may include a representation of a given speech sound of the first linguistic term speech sounds 142 (e.g., spectral features of the audio utterance). Additionally, each state may also be associated with one or more state transitions that specify a probability of making a transition from a current state to another state. Thus, the speech synthesis module 120 may perform concatenative speech unit synthesis by concatenating speech units (e.g., speech sounds) that correspond to the HMM chain to generate the synthetic audio signal via the output interface 114.

When applied to a device such as the device 100, in some examples, the combination of the multivariate Gaussian distributions and the state transitions for each state may define a sequence of utterances corresponding to one or more phonemes. For example, the HMM may model the sequences of phonemes that define words in the input text received via the input interface 112. Thus, some HMM-based acoustic models may also take into account phoneme context (e.g., join cost) when mapping a sequence of utterances to one or more words.

As described earlier, the process of selecting a first speech sound from the first linguistic term speech sounds 142 and a second speech sound from the second linguistic term speech sounds 144 for concatenation may include minimizing the target cost and the join cost of the concatenation. For example, minimizing the target cost may correspond to selecting the first speech sound from the first linguistic term speech sounds 142 that most similarly matches the first linguistic term 132 (e.g., sound that most matches letters "ca" in the word "cat"). Additionally, for example, minimizing the join cost may correspond to selecting the first speech sound having concatenation features most similar to concatenation features of the second speech sound as described above.

In some examples, the first linguistic term speech sounds 142 may be clustered based on the concatenation features into one or more clusters. For example, speech sounds having a fundamental frequency value (F0) in a central portion within a threshold distance from a given value may be included in a given cluster. In these examples, the speech synthesis module 120 may be configured to provide a representative speech sound from the given cluster as the first speech sound for concatenation. Advantages of the clustering, as described earlier, may include removing redundant speech sounds from the first linguistic term speech sounds 142 that have similar concatenation features for example.

Figure 2:
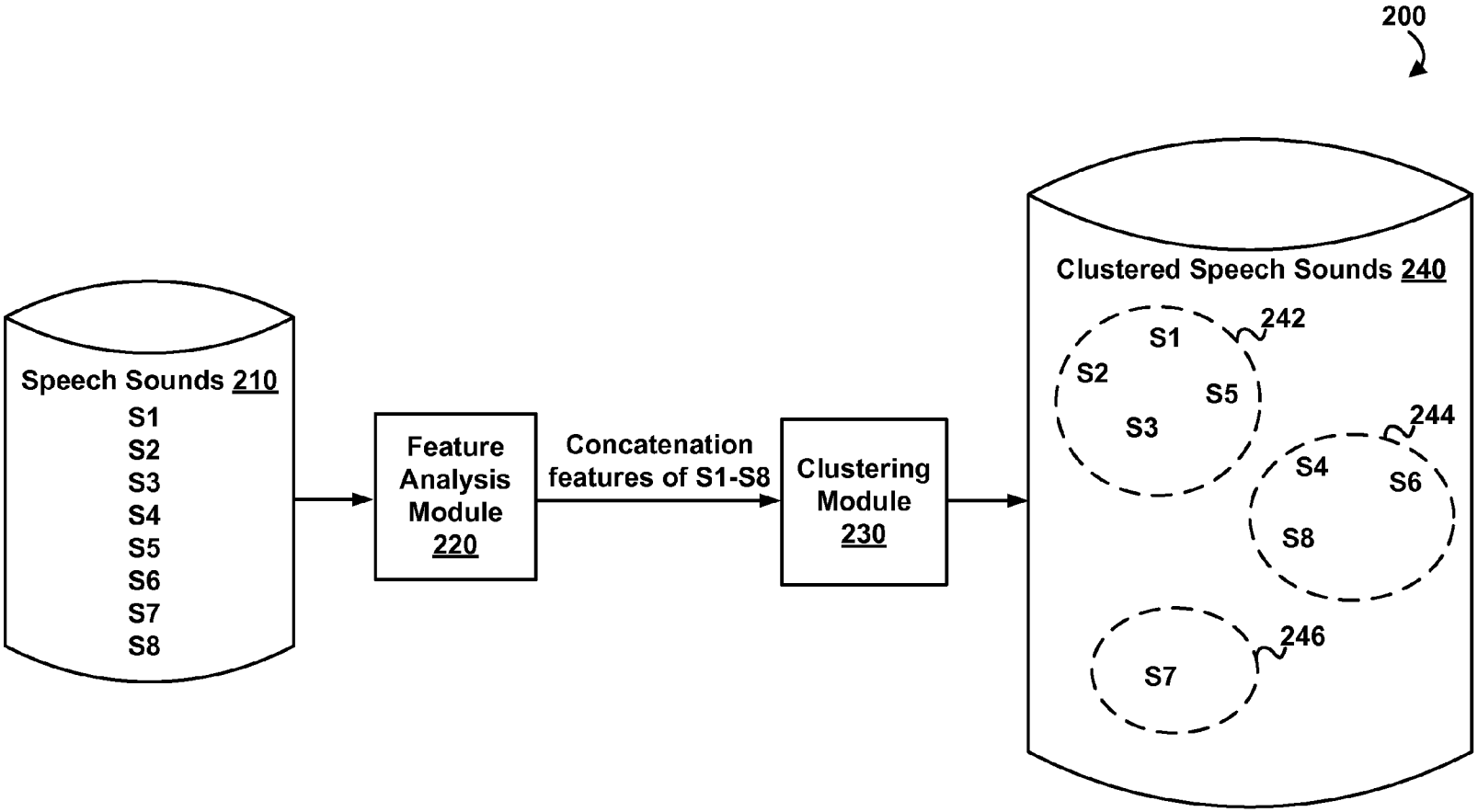
FIG. 2 illustrates an example system for clustering a plurality of speech sounds based on concatenation features, in accordance with at least some embodiments described herein.

FIG. 2 illustrates an example system 200 for clustering a plurality of speech sounds 210 based on concatenation features, in accordance with at least some embodiments described herein. The functions of the system 200 may be implemented by a computing device such as the device 100 of FIG. 1, for example, or any other computing device configured to perform the functions of the system 200. In some examples, clustered speech sounds 240 may be provided to the speech synthesis module 120 for selecting a representative speech sound as the first speech sound for concatenation (e.g., as discussed in the description of the device 100).

The plurality of speech sounds 210 may be indicative of pronunciations of a given linguistic term. For example, the speech sounds 210 may comprise the first linguistic term speech sounds 142 or the second linguistic term speech sounds 144 described in the device 100 of FIG. 1. In some examples, the speech sounds 210 may include speech sounds S1-S8 as illustrated in FIG. 2 that correspond to pronunciations of the given linguistic term. For example, S1-S8 may correspond to various recitations of the letters "ca." In this example, S1 may be a recitation of the letters "ca" having a longer duration than in S2, and S3 may have a recitation of the letters "ca" with a given pitch profile (e.g., F0 values) different from pitch profile of S4 for example.

Although illustrated that the speech sounds 210 include only eight speech sounds S1-S8, in some, the speech sounds 210 may include more or less speech sounds. For example, the speech sounds 210 may include one, two, three or more speech sounds that correspond to pronunciations of the given linguistic term.

Feature analysis module 220 may be a software component, similarly to the speech synthesis module 120 of the device 100, and may be stored on a memory such as the memory 118 of the device 100. In some examples, the feature analysis module 220 may be configured to determine concatenation features of the plurality of speech sounds 210. The concatenation features may be indicative of an acoustic transition between a first speech sound and a second speech sound when the first speech sound and the second speech sound are concatenated. The first speech sound may be indicative of a pronunciation of the given linguistic term and the second speech sound may be indicative of a pronunciation of a second linguistic term. For example, referring back to FIG. 1, the first speech sound may be included in the first linguistic term speech sounds 142 and the second speech sound may be included in the second linguistic term speech sounds 144.

As described earlier, the concatenation features may correspond to acoustic features in the first speech sound that relate to the join cost of concatenating the first speech sound with the second speech sound. For example, the concatenation features may correspond to acoustic features in a portion of the first speech sound that pertain, when the first speech sound is concatenated with the second speech sound, to prosody of the concatenation (e.g., discontinuity between the concatenated speech sounds).

In some examples, the concatenation features in the first speech sound may include one or more of a first fundamental frequency value (F0), a last F0, at least one frame of a spectral representation of a beginning portion of the first speech sound, or at least one frame of a spectral representation of an ending portion of the first speech sound. In some examples, the spectral representation may include any spectral envelope representation such as Mel Frequency Cepstrum Coefficients (MFCC), Mel Cepstral Coefficients (MCC), log-amplitude spectra, line spectral pairs (LSPs), etc. In some examples, the first speech sound may be indicative of a pronunciation of a diphone. For example, a first half of the diphone may correspond to a first phoneme and a second half of the diphone may correspond to a second phoneme. In these examples, the concatenation features may also include one or more of a duration of the pronunciation of the first half of the diphone, a duration of the pronunciation of the second half of the diphone, F0 of the pronunciation of the first half of the diphone, F0 of the pronunciation of a center portion of the diphone, or F0 of the pronunciation of the second half of the diphone. In some examples, other concatenation features may be possible such as an F0 value of a specific portion of the first speech sound, etc. Additionally or alternatively, in some examples, the concatenation features may include other features than the concatenation features described above such as MFCC frames of a central portion of the first speech sound or a first F0 value of the first speech sound. For example, the first speech sound may be indicative of pronunciation of a triphone, and the concatenation features may include a duration of pronunciation of a central phoneme of the triphone.

Thus, the concatenation features described above pertain to the acoustic transition between the first speech sound and the second speech sound when the first and second speech sounds are concatenated. For example, the concatenation features described above may pertain to perception of a discontinuity between the first speech sound and the second speech sound when the first speech sound and the second speech sound are concatenated. In some examples, the feature analysis module 220 may be configured to determine values for one or more of the concatenation features described above for the speech sounds S1-S8 in the plurality of speech sounds 210.

In some examples, feature analysis module 220 may be a software component stored on a memory and configured to operate a device, similarly to the speech synthesis module 120 stored on the memory 118 to operate the device 110. In some examples, the clustering module 230 may be configured to receive the concatenation features from the feature analysis module 220 and cluster the plurality of speech sounds 210 into one or more clusters such that a given cluster includes one or more of the plurality of speech sounds 210 that are related by a clustering metric. In some examples, the clustering metric may include various clustering algorithms such as connectivity-based clustering, centroid-based clustering, distribution-based clustering, or density-based clustering.

In some examples, a centroid-based cluster may be represented by a central vector (e.g., centroid), which may not necessarily be a member of the plurality of speech sounds 210. For example, the centroid may be indicative of mean values of the concatenation features in the plurality of speech sounds 210. For example, k-means clustering is an example centroid-based clustering method where the system 200 may receive configuration input indicative of a quantity (k) of the one or more clusters. In this example, the clustering module 230 may then determine the values of the k centroids using an optimization algorithm such as Lloyd's algorithm for example. For example, a given speech sound of speech sounds 210 (e.g., S1, S2, etc.) may be included in the given cluster based on having concatenation features that are less than a threshold distance from the centroid of the given cluster. In some examples of k-means clustering, the configuration input may also include instructions for normalizing values of the concatenation features of the speech sounds 210 (e.g., S1-S8) such that the k-means clustering algorithm considers the concatenation features to have equal importance when clustering.

In some examples, a distribution-based cluster may include speech sounds from the plurality of speech sounds 210 that have concatenation features associated with a given statistical distribution (e.g., Gaussian distribution, Bernoulli distribution, binomial distribution, etc.). In some examples, a density-based cluster may include speech sounds from the plurality of speech sounds 210 that have concatenation features such that the density-based cluster has a given density greater than a threshold density. In some examples, a connectivity-based cluster may include speech sounds from the plurality of speech sounds 210 that have concatenation features that have a connectivity distance that is less than the threshold distance. For example, the connectivity-based cluster may include S1, S2, and S3 such that the difference in last F0 between S1-S2 when added to the difference in last F0 between S2-S3 is less than the threshold distance.

Various other clustering methods may be possible for the clustering module 230 to determine the clustered speech sounds 240 based on the concatenation features provided by the feature analysis module 220 (e.g., subspace clustering, correlation clustering, hierarchical clustering, etc.).

The clustered speech sounds 240 include clusters 242, 244 and 246 that include one or more of the plurality of speech sounds 210. For example, cluster 242 includes speech sounds S1, S2, S3, and S5. As described earlier, clustering the plurality of speech sounds 210 into clusters 242, 244, and 246 may be advantageous. For example, the speech synthesis module 120 of the device 100 may attempt to obtain the first speech sound for concatenation from first linguistic term speech sounds 142 that is clustered similarly to the clustered speech sounds 240. In this example, the system 200 may determine that the concatenation features of the first speech sound is represented by the cluster 242 for example, and thus, the system 200 may provide a representative speech sound (e.g., S2) as the first speech sound to the speech synthesis module 120.

The selection of the representative speech sound may be based on various metrics. In one example, if the cluster 242 was determined based on a centroid-based metric (e.g., via k-means clustering) the representative speech sound may be a given speech sound with a minimum distance to the centroid of the cluster 242 compared to other speech sounds in the cluster 242. In another example, if the cluster 242 was determined based on a distribution-based metric, the representative speech sound may be a given speech sound closest to a median of the distribution.

Additionally, in some examples, the system 200 may be configured to remove speech sounds from the clustered speech sounds 240 to reduce size of the clustered speech sounds 240 while maintaining sparsity of the remaining speech sounds from the concatenation features perspective (e.g., join cost perspective). For example, the system 200 may be configured to keep a representative speech sound from each of the clusters 242, 244, and 246 and remove all other speech sounds (e.g., keep S3, S8 and S7). Thus, in this example, the size of the clustered speech sounds 240 may be reduced where size limitations exist (e.g., limited memory resources, etc.) while maintaining sparsity from the join cost perspective.

Figure 3:
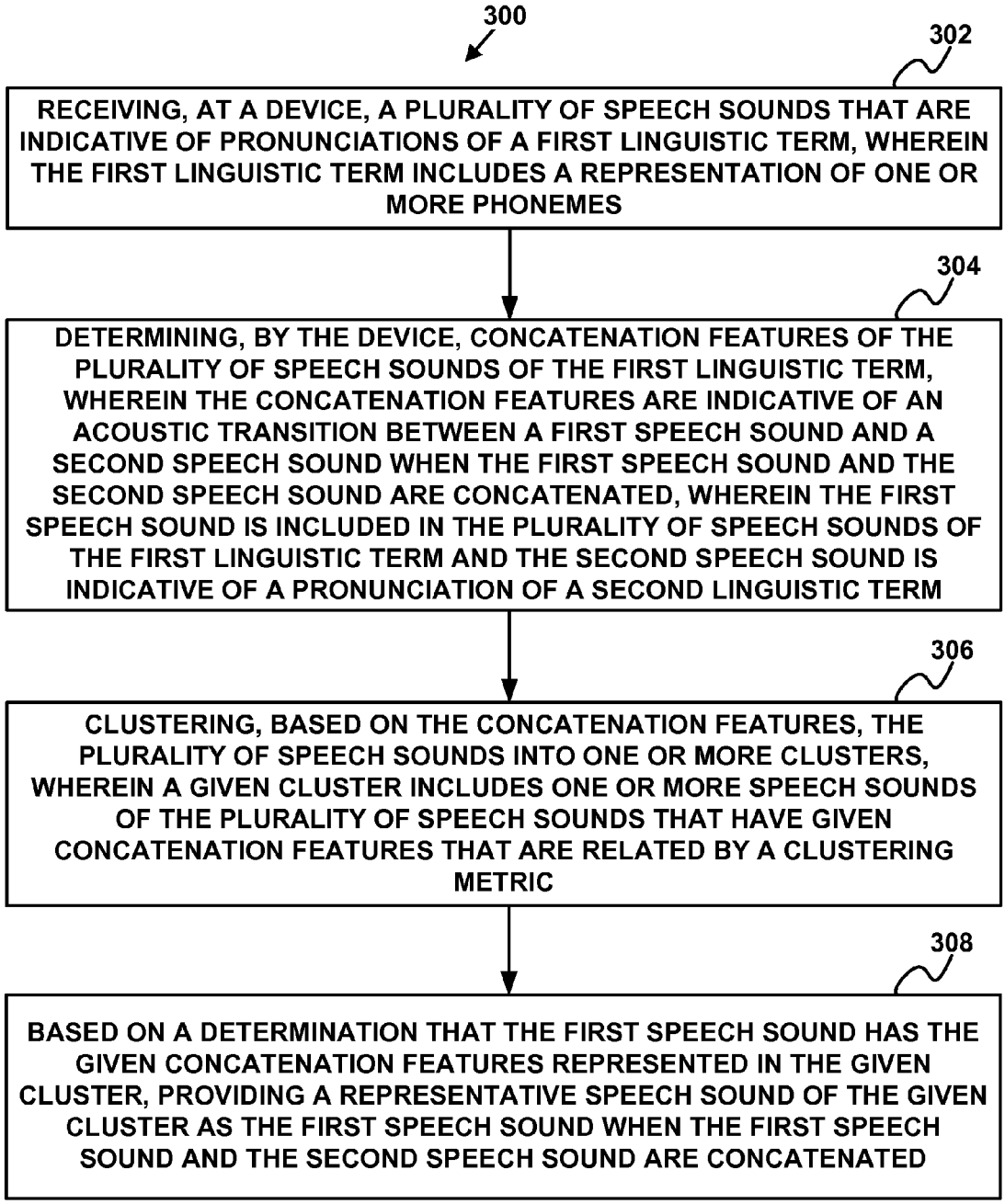
FIG. 3 is a block diagram of an example method for clustering a plurality of speech sounds based on concatenation features, in accordance with at least some embodiments described herein.

FIG. 3 is a block diagram of an example method 300 for clustering a plurality of speech sounds based on concatenation features, in accordance with at least some embodiments described herein. Method 300 shown in FIG. 3 presents an embodiment of a method that could be used with the device 100 and/or the system 200, for example. Method 300 may include one or more operations, functions, or actions as illustrated by one or more of blocks 302-308. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 300 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In addition, for the method 300 and other processes and methods disclosed herein, each block in FIG. 3 may represent circuitry that is wired to perform the specific logical functions in the process.

At block 302, the method 300 includes receiving a plurality of speech sounds that are indicative of pronunciations of a first linguistic term at a device. The first linguistic term may include a representation of one or more phonemes. For example, the device may be a computing device such as a server and may receive the plurality of speech sounds associated with the first linguistic term such as the first linguistic term speech sounds 142 of device 100 or the plurality of speech sounds 210 of system 200.

At block 304, the method 300 includes determining concatenation features of the plurality of speech sounds of the first linguistic term by the device. The concatenation features may be indicative of an acoustic transition between a first speech sound and a second speech sound when the first speech sound and the second speech sound are concatenated. The first speech sound may be included in the plurality of speech sounds of the first linguistic term and the second speech sound may be indicative of a pronunciation of a second linguistic term. For example, block 304 may refer to the functions of the feature analysis module 220 of system 200 in FIG. 2. Additionally, the concatenation features may include one or more of the concatenation features described in the feature analysis module 220. For example, the concatenation features may include value of duration of a second half of the first speech sound, and/or a pitch (e.g., F0) of a central portion of the first speech sound. Additionally, in some examples, values of the concatenation features may be determined at block 304 by the device for other speech sounds in the plurality of speech sounds.

At block 306, the method 300 includes clustering the plurality of speech sounds into one or more clusters based on the concatenation features. A given cluster of the one or more clusters may include one or more speech sounds of the plurality of speech sounds that have given concatenation features that are related by a clustering metric.

For example, the device may be configured to perform centroid-based clustering, and the plurality of speech sounds may be clustered into the one or more clusters based on having the given concatenation features that are within a threshold distance from a corresponding centroid. For example, a centroid of a given cluster may correspond to a last F0 value of 2 kHz, and the threshold distance may be 500 Hz. Thus, in this example, the given cluster may include given speech sounds of the plurality of speech sounds that have last F0 value in the range of 1.5 kHz-2.5 kHz. In some examples, the centroid may include more than one concatenation feature. In the example above, the given cluster may correspond to the last F0 value of 2 kHz (having threshold 500 Hz) and a duration of a first half of a diphone of 1.5 sec (having threshold of 0.2 sec) for example.

In some examples, the method 300 may also include receiving configuration input indicative of a selection of the concatenation features by the device. For example, the device may receive the configuration input that includes instructions to include only the last MFCC frame and the duration of the first half of a given speech sound in the plurality of speech sounds when determining the concatenation features and their corresponding values for the plurality of speech sounds. In this example, the given cluster may have a centroid that corresponds to mean values of the selected concatenation features for the one or more speech sounds included in the given cluster. Thus, in some examples, the instructions may be indicative of including a specific combination of the concatenation features described in the feature analysis module 220 of system 200 when clustering the plurality of speech sounds.

In some examples, the configuration input may further include instructions that define aspects of the concatenation features selected for inclusion. For example, the configuration input may include instructions for including F0 values of the central 10%, 15%, or 20% portion of a given speech sound of the plurality of speech sounds, or initialization information for calculating an MFCC frame for example.

At block 308, the method 300 includes providing a representative speech sound of the given cluster as the first speech sound when the first speech sound and the second speech sound are concatenated. The provision of the representative speech sound may be based on a determination that the first speech sound has the given concatenation features represented in the given cluster. For example, the device may include a module such as the speech synthesis module 120 of the device 100. In this example, the device may attempt to concatenate the first speech sound of the plurality of speech sounds with the second speech sound that is associated with the second linguistic term. Thus, for example, the device may select the first speech sound from the plurality of speech sounds by determining that the first speech sound has the concatenation features represented in the given cluster, and based on the determination, the device may provide the representative speech sound from the given cluster as the first speech sound for concatenation.

The selection of the representative speech sound may be based on various factors. For example, if the one or more clusters were determined based on a centroid-based metric (e.g., k-means clustering), the representative speech sound may be selected based on having a minimum distance to the centroid of the given cluster compared to other speech sounds in the given cluster. In another example, the one or more clusters may be determined based on a density-based metric. In this example, the representative speech sound may be selected based on being at a minimum distance from the geometric center of the highest density area in the given cluster for example.

Figure 4:
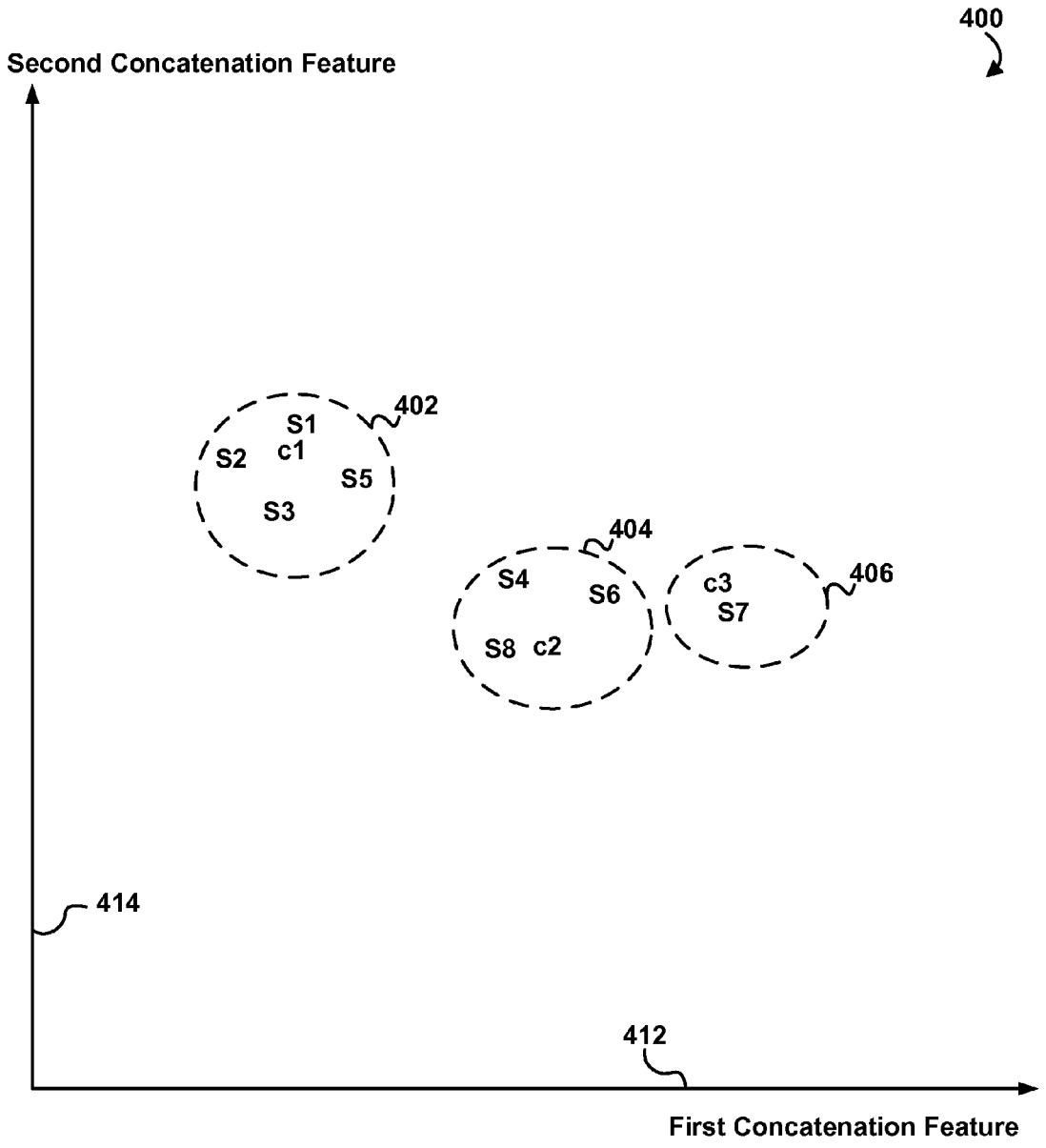
FIG. 4 illustrates an example space representation of clustered speech sounds, in accordance with at least some embodiments described herein.

FIG. 4 illustrates an example space representation 400 of clustered speech sounds, in accordance with at least some embodiments described herein. In some examples, the clustered speech sounds in the space representation 400 may correspond to the clustered speech sounds 240 of the system 200. For example, clusters 402-406 may correspond, respectively, to clusters 242-246 included in the clustered speech sounds 240 of system 200. Additionally, for example, speech sounds S1-S8 included in clusters 402-406 may correspond to speech sounds S1-S8 illustrated in FIG. 2 that are associated with a given linguistic term. Thus, in some examples, the space representation 400 may illustrate operation of the clustering module 230 of the system 200.

Although illustrated that the space representation 400 includes only eight speech sounds S1-S8, in some examples, the space representation 400 may include more or less speech sounds. For example, the space representation 400 may include one, two, three or more speech sounds that correspond to pronunciations of the given linguistic term.

The space representation 400 includes a first dimension 412 and a second dimension 414. In some examples, the first dimension 412 may be representative of a first concatenation feature and the second dimension 414 may be representative of a second concatenation feature. For example, the first concatenation feature may refer to a duration of a first half of a given speech sound of speech sounds S1-S8 (e.g., first half of diphone) and the second concatenation feature may refer to a last F0 value of the given speech sound. Thus, speech sounds S1-S8 are illustrated in the space representation 400 according to corresponding values of the first concatenation feature and the second concatenation feature for the speech sounds S1-S8. For example, S2 may have a first-half duration of 1.2 sec and S7 may have a first-half duration of 2.8 sec. Similarly, for example, S2 may have a last-F0 value of 2.3 kHz and S7 may have a last-F0 value of 1.1 kHz. It is noted that in the example above the values are not to scale with FIG. 4 and are only presented for illustrative purposes.

Although illustrated in FIG. 4 that the space representation 400 includes two dimensions (412 and 414), in some examples, the space representation 400 may include only one dimension or more than two dimensions. For example, the space representation 400 may include eight dimensions that are each assigned to one of the concatenation features described in the operation of feature analysis module 220 of system 200. Additionally, in some examples, the first dimension 412 and/or the second dimension 414 may include positive and/or negative values. For example, the first dimension 412 may be indicative of a last MFCC frame, and S4 may have a negative last MFCC frame value.

The clusters 402-406 may include one or more of the speech sounds S1-S8 based on various clustering metrics as discussed in the description of the clustering module 230 of system 200. For example, the clusters 402-406 may be determined based on a centroid-based metric (e.g., k-means clustering, k-medoid clustering, k-median clustering, etc.). In this example, centroids of the clusters 402-406 may be determined based on the centroid metric. For example, as illustrated in FIG. 4, clusters 402-406 may have, respectively, centroids c1-c3. In the example of k-means clustering, the centroid c1 may be determined to have a value in the first dimension 412 that is equal to a mean of the values of the first concatenation feature of S1, S2, S3, and S5. Additionally, in this example, the centroid c1 may have a value in the second dimension 414 that is equal to a mean of the values of the second concatenation feature for S1, S2, S3, and S5. Similarly, in this example, the centroids c2 and c3 may be determined, respectively, based on speech sounds (S4, S6, S8) and speech sound (S7) included in the corresponding clusters 404-406.

Although illustrated in FIG. 4 that the space representation 400 includes three clusters (402-406), in some examples, the space representation 400 may include one cluster, two clusters, or more. For example, the space representation 400 may include a cluster for each speech sound included in the space representation 400. Additionally, in some examples, a quantity of the clusters may be based on configuration input received by the clustering device. In one example, where the clustering metric is a centroid-based metric, the number of clusters may be included in the configuration input. In another example, the configuration input may include instructions for a target reduction of the speech sounds S1-S8 and the device performing the clustering may determine the quantity of clusters based on the target reduction.

In some examples, a TTS such as the device 100 may be configured to concatenate a first speech sound of the given linguistic term represented by the space representation 400 with a second speech sound associated with a second linguistic term other than the given linguistic term. In these examples, the TTS may provide a representative speech sound from a given cluster of the clusters 402-406 as the first speech sound based on the first speech sound having given concatenation features that are represented by the given cluster.

In one example, the TTS may determine that the first speech sound has values for the first concatenation feature and the second concatenation feature that are closer to centroid c1 than centroids c2 and c3. In this example, the TTS may provide the representative speech sound of cluster 402 (e.g., S1) as the first speech sound.

In another example, the TTS may determine that the first speech sound has the values that are within a range of values of the speech sounds included in the cluster 404 (e.g., first concatenation feature value lower than S6 but greater than S8 and second concatenation feature value lower than S4 and greater than S8). In this example, the TTS may then provide the representative speech sound from the cluster 404 (e.g., S8).

In some examples, the TTS may be configured to reduce the size of the plurality of speech sounds S1-S8 while maintaining sparsity from concatenation feature point of view (e.g., join cost point of view). For example, the TTS may have limited memory resources. In these examples, the TTS may be configured to keep a representative speech sound from each of the clusters 402-407 and discard all other speech sounds in the space representation 400. For example, the TTS may keep (S1, S7, and S8) and discard (S2, S3, S4, S5, and S6). Thus, in this example, the remaining speech sounds (S1, S7, and S8) maintain sparsity of the speech sounds S1-S8 from the perspective of the first concatenation feature (e.g., first dimension 412) and the second concatenation feature (e.g., second dimension 414). In the examples above, the TTS may determine that the first speech sound has values of the first and second concatenation features that are closer to one of the representative speech sounds (S1, S7, S8) than others. For example, the values may be closer to S8 than S1 and S7, and thus, the TTS may provide S8 as the first speech sound.

The selection of the representative speech sounds may be based on various factors. For example, in centroid-based clustering, the selected speech sound may be selected based on having a minimum distance from a corresponding centroid compared to other speech sounds in the cluster. For example, as illustrated in FIG. 4, speech sound S1 may have the minimum distance from centroid c1 compared to speech sounds S2, S3, and S5 that are included in the cluster 402. Similarly, for example, the speech sounds (S8, S7) may be closer, respectively, to the centroids (c2, c3) than other speech sounds in the corresponding cluster as illustrated in FIG. 4.

Figure 5:
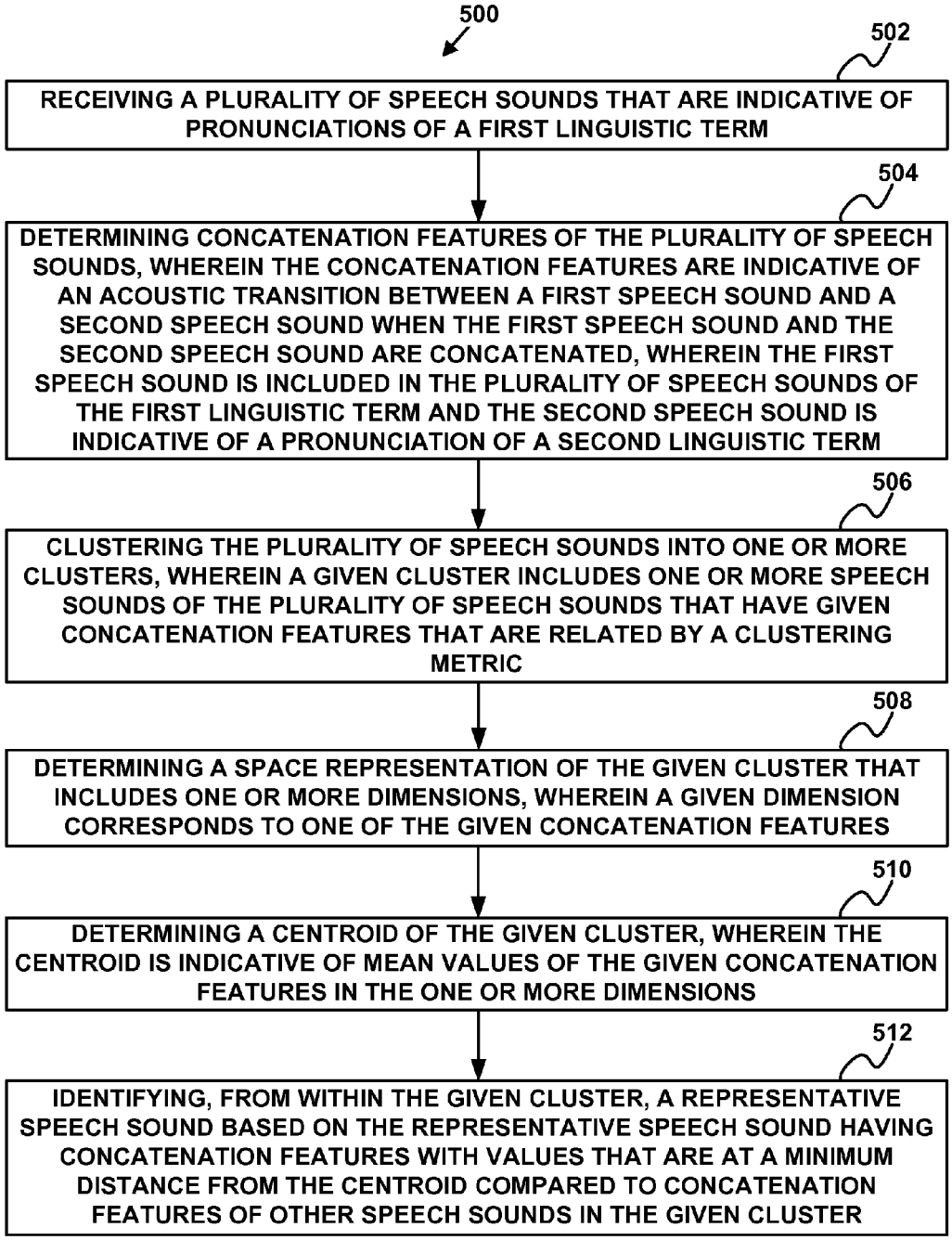
FIG. 5 is a block diagram of an example method for identifying a representative speech sound of a given cluster, in accordance with at least some embodiments described herein.

FIG. 5 is a block diagram of an example method 500 for identifying a representative speech sound of a given cluster, in accordance with at least some embodiments described herein. Method 500 shown in FIG. 5 presents an embodiment of a method that could be used with the device 100 and/or the system 200, for example. Method 500 may include one or more operations, functions, or actions as illustrated by one or more of 502-512. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 502, the method 500 includes receiving a plurality of speech sounds that are indicative of pronunciations of a first linguistic term. For example, a computing device such as a smart watch with TTS capabilities may be configured to receive a plurality of speech sounds similar to first linguistic term speech sounds 142, second linguistic term speech sounds 144, or speech sounds 210 of the device 100 and the system 200.

At block 504, the method 500 includes determining concatenation features of the plurality of speech sounds. The concatenation features may be indicative of an acoustic transition between a first speech sound and a second speech sound when the first speech sound and the second speech sound are concatenated. The first speech sound may be included in the plurality of speech sounds of the first linguistic term and the second speech sound may be indicative of a pronunciation of a second linguistic term. For example, the computing device may perform the functions of the feature analysis module 220 of system 200 and determine the concatenation features (e.g., features that are relevant to the join cost during concatenation speech synthesis).

At block 506, the method 500 includes clustering the plurality of speech sounds into one or more clusters. A given cluster of the one or more clusters may include one or more speech sounds of the plurality of speech sounds that have given concatenation features that are related by a clustering metric. For example, the functions of the clustering module 240 of system 200 may be performed by the computing device at block 506.

In some examples, the method 500 may further include receiving configuration input indicative of a reduction for the plurality of speech sounds. For example, the configuration input received by the computing device may include instructions for reducing the plurality of speech sounds to a target level (e.g., 50% of the original). Further, in some examples, the method 500 may include determining a quantity of the one or more clusters based on the reduction. For example, the computing device may determine that the plurality of speech sounds may be clustered into three clusters (e.g., the one or more clusters are the three clusters) to achieve the reduction to the target level.

At block 508, the method 500 includes determining a space representation of the given cluster that includes one or more dimensions. A given dimension of the one or more dimensions may correspond to one of the given concatenation features. For example, referring back to FIG. 4, the one or more dimensions may include the first dimension 412 and the second dimension 414. Additionally, for example, the given dimension may be the first dimension 412 and the one concatenation feature may be the first concatenation feature (e.g., First MFCC frame).

At block 510, the method 500 includes determining a centroid of the given cluster. The centroid may be indicative of mean values of the given concatenation features in the one or more dimensions. Referring back to FIG. 4, the given cluster may refer to the cluster 404 and the centroid may refer to the centroid c2. For example, the computing device may perform k-means clustering to determine the centroid c2 such that (as illustrated in FIG. 4) c2 has the mean value in the first dimension 412 of the values of the first concatenation feature for S4, S6, and S8, and the mean value in the second dimension 414 of the values of the second concatenation feature for S4, S6, and S8.

At block 512, the method 500 includes identifying a representative speech sound from within the given cluster. The identification of the representative speech sound may be based on the representative speech sound having concatenation features with values that are at a minimum distance from the centroid compared to concatenation features of other speech sounds in the given cluster. Referring back to the example in block 510, the representative speech sound may be selected as S8 based on S8 having the minimum distance from the centroid c2 compared to S4 and S6 (as illustrated in FIG. 4).

Figure 6:
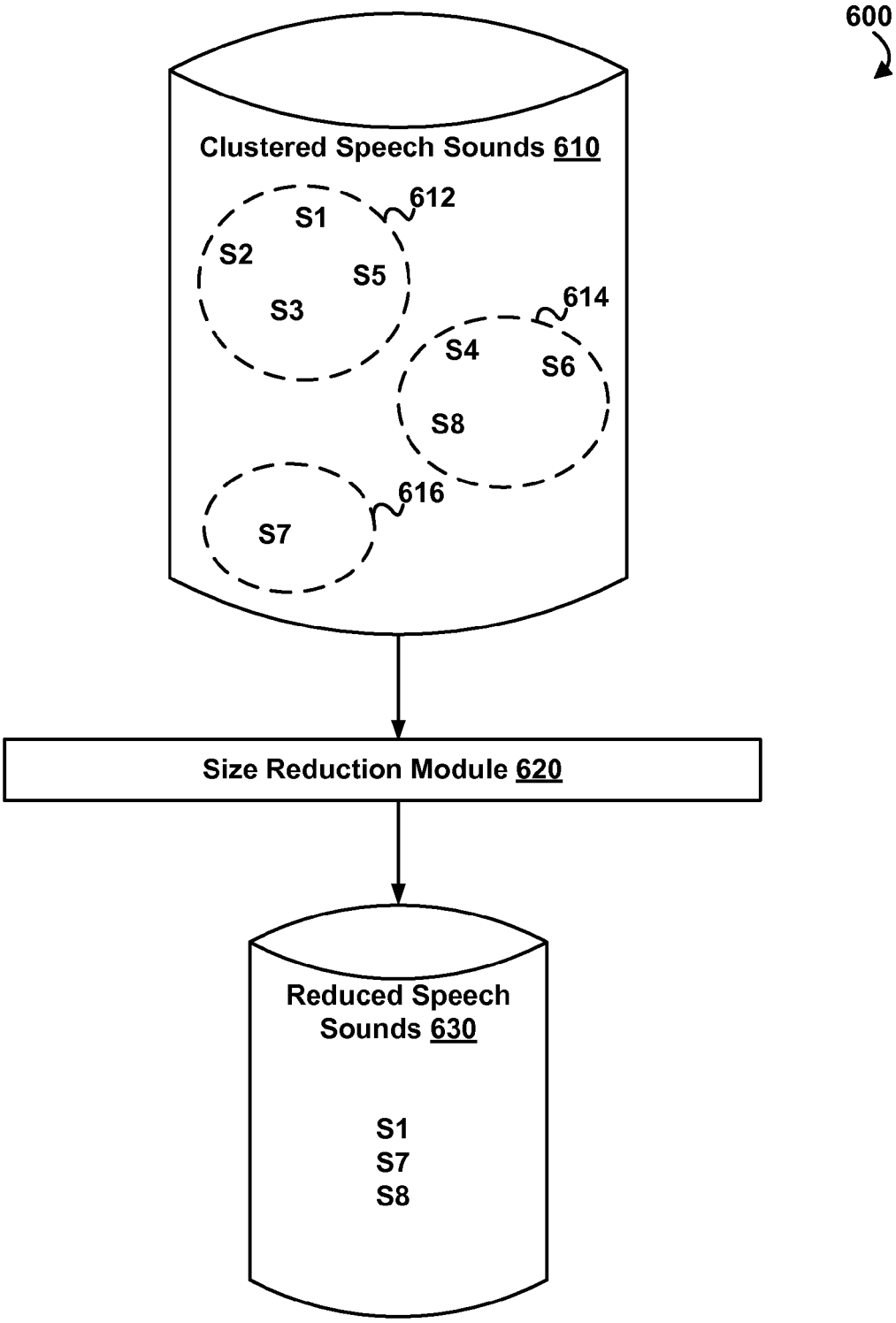
FIG. 6 illustrates an example system for reducing a plurality of speech sounds, in accordance with at least some embodiments described herein.

FIG. 6 illustrates an example system 600 for reducing a plurality of speech sounds, in accordance with at least some embodiments described herein. The functions of the system 600 may be implemented by a computing device such as the device 100 for example. The system 600 may include clustered speech sounds 610 that may be similar to the clustered speech sounds 240 of the system 200. For example, the clustered speech sounds 610 include speech sounds S1-S8 that are clustered in clusters 612-616 similarly to the speech sounds S1-S8 in the clusters 242-246 of the system 200. In some examples, the system 600 may receive the clustered speech sounds 610 from the system 200. For example, the clusters 612-616 may be determined by a module such as the clustering module 230 of the system 200. For example, speech sounds S1, S2, S3, and S5 in the cluster 612 may be related by a clustering metric such as the centroid-based metric or the density-based metric discussed in the description of the clustering module 230.

As discussed earlier, it may be advantageous to reduce size of the clustered speech sounds 610. For example, the speech sounds S1-S8 may be stored as audio files on a computing device with limited memory resources. Thus, some embodiments of the system 600 may include reducing the size of the clustered speech sounds 610 while maintaining sparsity of the speech sounds from the perspective of concatenation features (e.g., join cost).

In the system 600, the clustered speech sounds 610 may be received by size reduction module 620 configured to reduce the size of the plurality of speech sounds S1-S8. In some examples, the size reduction module 620 may be configured to keep a representative speech sound from each of the clusters 612-614 and remove other speech sounds. Consequently, for example, the size reduction module 620 may determine reduced speech sounds 630 that include the representative speech sounds of the clusters 612-616 such that sparsity from the concatenation feature point of view is maintained. For example, the reduced speech sounds 630 may include the speech sound S1 as the representative speech sound from cluster 612, the speech sound S8 as the representative speech sound from cluster 614, and the speech sound S7 as the representative speech sound from cluster 616 as illustrated in FIG. 6. Although illustrated in FIG. 6 that S1, S7, and S8 are the selected representative speech sounds, in some examples, the reduced speech sounds 630 may include other representative speech sounds from the clusters 612-616. For example, the speech sound S2, S3, or S5 may be selected as the representative speech sound of the cluster 612 instead of the speech sound S1.

As discussed earlier, various methods may be used to select the representative speech sounds of the clusters 612-616 such as the method 500. In one example, the clusters 612-616 may be determined based on a centroid-based metric ("clustering metric"), and the representative speech sound may be selected based on having a minimum distance from a centroid of the corresponding cluster compared to other speech sounds in the corresponding cluster. In another example, the clusters 612-616 may be determined based on a distribution-based metric ("clustering metric"), and the representative speech sound may be selected based on having a minimum distance from a maximum or minimum of a given distribution.

Figure 7:
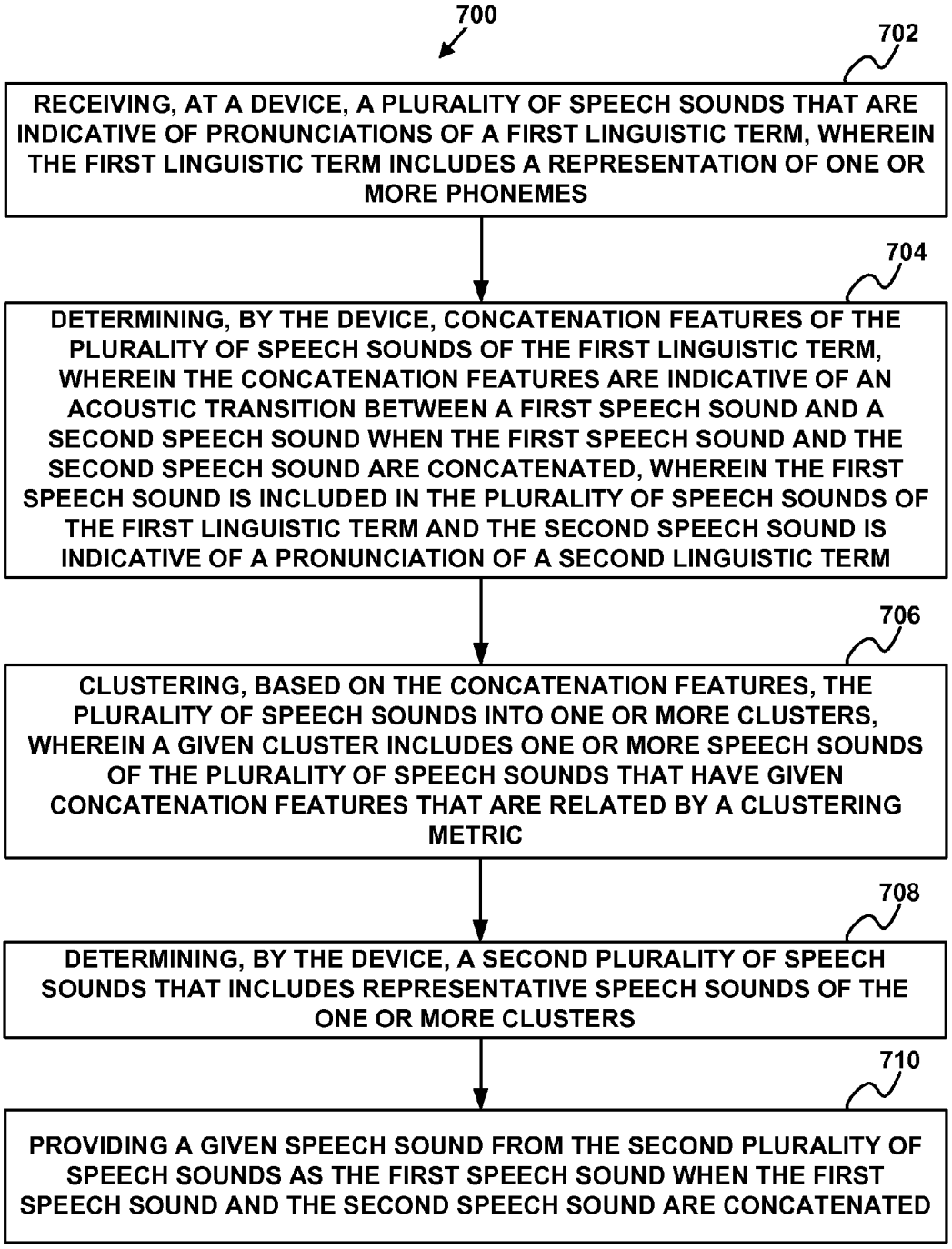
FIG. 7 is a block diagram of an example method for providing representative speech sounds of one or more clusters of speech sounds, in accordance with at least some embodiments described herein.

FIG. 7 is a block diagram of an example method 700 for providing representative speech sounds of one or more clusters of speech sounds, in accordance with at least some embodiments described herein. Method 700 shown in FIG. 7 presents an embodiment of a method that could be used with the device 100, the system 200 and/or the system 600, for example. Method 700 may include one or more operations, functions, or actions as illustrated by one or more of 702-710. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 702, the method 700 includes receiving a plurality of speech sounds that are indicative of pronunciations of a first linguistic term at a device. The first linguistic term may include a representation of one or more phonemes. For example, a computing device such as a personal computer may be configured to receive the plurality of speech sounds similar to first linguistic term speech sounds 142, second linguistic term speech sounds 144, or speech sounds 210 of the device 100 and the system 200.

At block 704, the method 700 includes determining concatenation features of the plurality of speech sounds. The concatenation features may be indicative of an acoustic transition between a first speech sound and a second speech sound when the first speech sound and the second speech sound are concatenated. The first speech sound may be included in the plurality of speech sounds of the first linguistic term and the second speech sound may be indicative of a pronunciation of a second linguistic term. For example, the device may perform the functions of the feature analysis module 220 of system 200 and determine the concatenation features (e.g., duration of first half of diphone, F0 of center of diphone, etc.).

At block 706, the method 700 includes clustering the plurality of speech sounds into one or more clusters based on the concatenation features. A given cluster of the one or more clusters may include one or more speech sounds of the plurality of speech sounds that have given concatenation features that are related by a clustering metric. For example, the functions of the clustering module 240 of system 200 may be performed by the device at block 706 to cluster the plurality of speech sounds into clustered speech sounds such as the clustered speech sounds 610 of the system 600.

At block 708, the method 700 includes determining a second plurality of speech sounds that includes representative speech sounds of the one or more clusters by the device. For example, the device may be configured to determine representative speech sounds of the one or more clusters similarly to the size reduction module 620 of the system 600 by using a method such as the methods discussed in the description of the space representation 400 or the method 500. For example, the clustering metric may correspond to a density-based metric, and the representative speech sound of a given cluster may be a given speech sound closest to a geometric center of a highest density area of the given cluster.

At block 710, the method 700 includes providing a given speech sound from the second plurality of speech sounds as the first speech sound when the first speech sound and the second speech sound are concatenated. For example, the device may include a module such as the speech synthesis module 120 of the device 100 and may provide, as the first speech sound, one of the second plurality of speech sounds that has the concatenation features that are at a minimum distance from target concatenation features of the first speech sound for concatenation. For example, the provided given speech sound may have the concatenation features that are similar to the concatenation features of the second speech sound, and thus, discontinuity between the first speech sound and the second speech sound may be minimized after concatenation.

Figure 8:
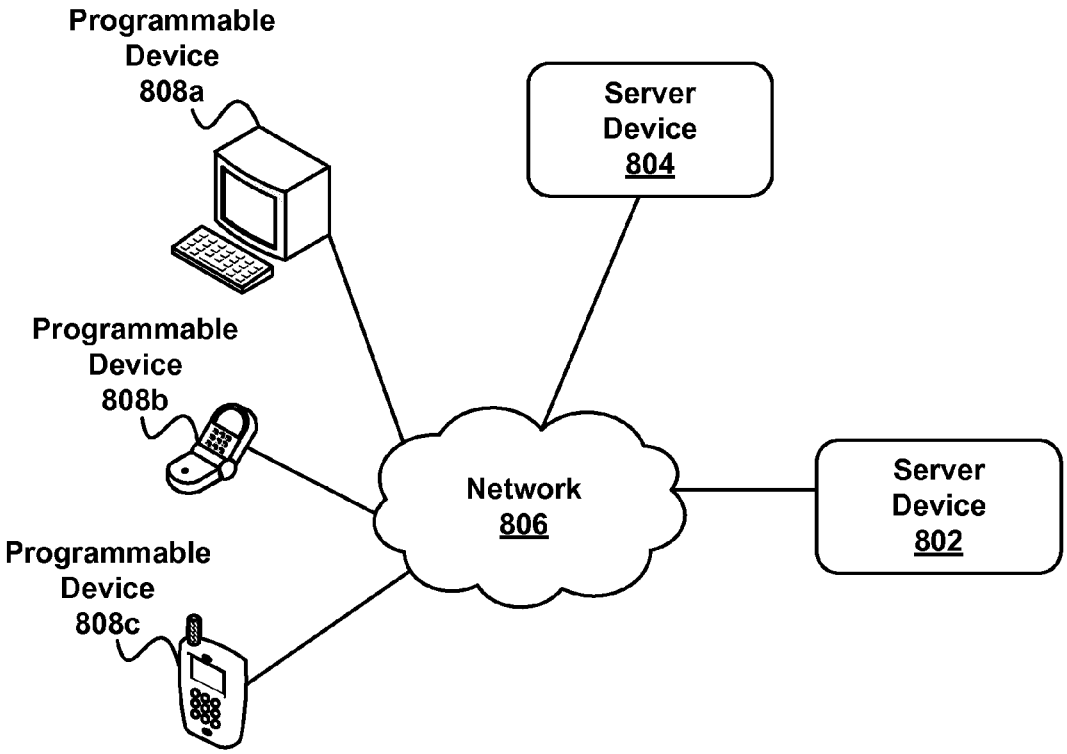
FIG. 8 illustrates an example distributed computing architecture, in accordance with at least some embodiments described herein.

FIG. 8 illustrates an example distributed computing architecture, in accordance with an example embodiment. FIG. 8 shows server devices 802 and 804 configured to communicate, via network 806, with programmable devices 808*a*, 808*b*, and 808*c*. The network 806 may correspond to a LAN, a wide area network (WAN), a corporate intranet, the public Internet, or any other type of network configured to provide a communications path between networked computing devices. The network 806 may also correspond to a combination of one or more LANs, WANs, corporate intranets, and/or the public Internet.

Although FIG. 8 shows three programmable devices, distributed application architectures may serve tens, hundreds, or thousands of programmable devices. Moreover, the programmable devices 808*a*, 808*b*, and 808*c* (or any additional programmable devices) may be any sort of computing device, such as an ordinary laptop computer, desktop computer, network terminal, wireless communication device (e.g., a tablet, a cell phone or smart phone, a wearable computing device, etc.), and so on. In some examples, the programmable devices 808*a*, 808*b*, and 808*c* may be dedicated to the design and use of software applications. In other examples, the programmable devices 808*a*, 808*b*, and 808*c* may be general purpose computers that are configured to perform a number of tasks and may not be dedicated to software development tools. For example the programmable devices 808*a*-808*c* may be configured to provide speech synthesis functionality similar to that discussed in FIGS. 1-7. For example, the programmable devices 808*a-c* may include a device such as the device 100.

The server devices 802 and 804 can be configured to perform one or more services, as requested by programmable devices 808*a*, 808*b*, and/or 808*c*. For example, server device 802 and/or 804 can provide content to the programmable devices 808*a*-808*c*. The content can include, but is not limited to, web pages, hypertext, scripts, binary data such as compiled software, images, audio, and/or video. The content can include compressed and/or uncompressed content. The content can be encrypted and/or unencrypted. Other types of content are possible as well.

As another example, the server device 802 and/or 804 can provide the programmable devices 808*a*-808*c* with access to software for database, search, computation (e.g., text-to-speech synthesis, feature analysis, clustering, size reduction, etc.), graphical, audio, video, World Wide Web/Internet utilization, and/or other functions. Many other examples of server devices are possible as well. In some examples, the server devices 802 and/or 804 may perform functions described in FIGS. 1-7 to cluster speech sounds based on concatenation features or reduce size of a plurality of speech sounds for example.

The server devices 802 and/or 804 can be cloud-based devices that store program logic and/or data of cloud-based applications and/or services. In some examples, the server devices 802 and/or 804 can be a single computing device residing in a single computing center. In other examples, the server device 802 and/or 804 can include multiple computing devices in a single computing center, or multiple computing devices located in multiple computing centers in diverse geographic locations. For example, FIG. 8 depicts each of the server devices 802 and 804 residing in different physical locations.

In some examples, data and services at the server devices 802 and/or 804 can be encoded as computer readable information stored in non-transitory, tangible computer readable media (or computer readable storage media) and accessible by programmable devices 808*a*, 808*b*, and 808*c*, and/or other computing devices. In some examples, data at the server device 802 and/or 804 can be stored on a single disk drive or other tangible storage media, or can be implemented on multiple disk drives or other tangible storage media located at one or more diverse geographic locations.

Figure 9:
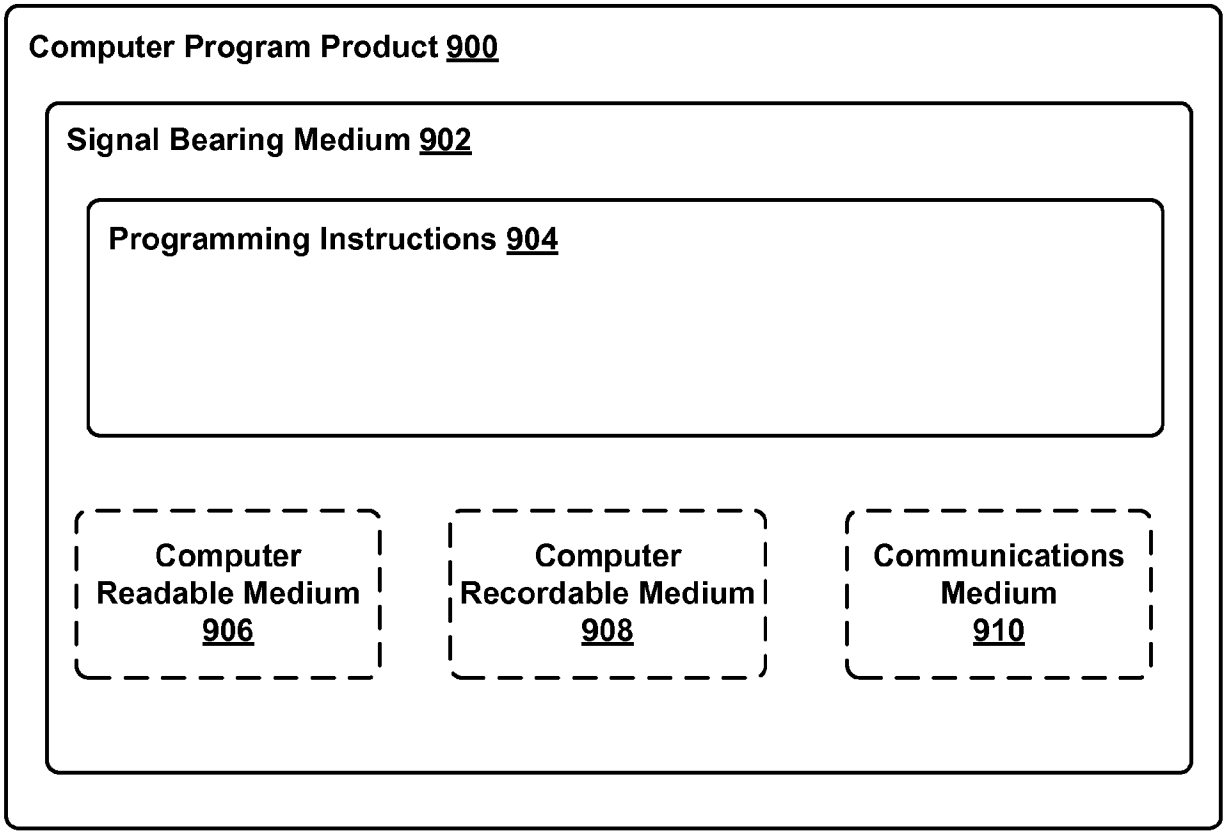
FIG. 9 depicts an example computer-readable medium configured according to at least some embodiments described herein.

FIG. 9 depicts an example computer-readable medium configured according to at least some embodiments described herein. In example embodiments, the example system can include one or more processors, one or more forms of memory, one or more input devices/interfaces, one or more output devices/interfaces, and machine readable instructions that when executed by the one or more processors cause the system to carry out the various functions tasks, capabilities, etc., described above.

As noted above, in some embodiments, the disclosed techniques (e.g. methods 300, 500, and 700) can be implemented by computer program instructions encoded on a computer readable storage media in a machine-readable format, or on other media or articles of manufacture (e.g., the instructions stored on the memory 118 of the device 100, or the instructions that operate the server devices 802-804 and/or the programmable devices 808*a*-808*c* in FIG. 8). FIG. 9 is a schematic illustrating a conceptual partial view of an example computer program product that includes a computer program for executing a computer process on a computing device, arranged according to at least some embodiments disclosed herein.

In one embodiment, the example computer program product 900 is provided using a signal bearing medium 902. The signal bearing medium 902 may include one or more programming instructions 904 that, when executed by one or more processors may provide functionality or portions of the functionality described above with respect to FIGS. 1-8. In some examples, the signal bearing medium 902 can be a computer-readable medium 906, such as, but not limited to, a hard disk drive, a Compact Disc (CD), a Digital Video Disk (DVD), a digital tape, memory, etc. In some implementations, the signal bearing medium 902 can be a computer recordable medium 908, such as, but not limited to, memory, read/write (R/W) CDs, R/W DVDs, etc. In some implementations, the signal bearing medium 902 can be a communication medium 910 (e.g., a fiber optic cable, a waveguide, a wired communications link, etc.). Thus, for example, the signal bearing medium 902 can be conveyed by a wireless form of the communications medium 910.

The one or more programming instructions 904 can be, for example, computer executable and/or logic implemented instructions. In some examples, a computing device such as the processor-equipped devices 110 and programmable devices 808*a-c* of FIGS. 1 and 8 is configured to provide various operations, functions, or actions in response to the programming instructions 904 conveyed to the computing device by one or more of the computer readable medium 906, the computer recordable medium 908, and/or the communications medium 910. In other examples, the computing device can be an external device such as server devices 802-804 of FIG. 8 in communication with a device such as device 110 or programmable devices 808*a*-808*c*.

The computer readable medium 906 can also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server. For example, the computer program product 800 can implement the functionalities discussed in the description of FIGS. 1-8.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

receiving, at a device, a plurality of speech sounds that are each indicative of a different full pronunciation of a first linguistic term, wherein the first linguistic term includes a representation of one or more phonemes;

determining, by the device, concatenation features of the plurality of speech sounds of the first linguistic term, wherein the concatenation features are indicative of an acoustic transition between a first speech sound and a second speech sound when the first speech sound and the second speech sound are concatenated, wherein the first speech sound is included in the plurality of speech sounds of the first linguistic term and the second speech sound is indicative of a pronunciation of a second linguistic term;

clustering, based on the concatenation features, the plurality of speech sounds into one or more clusters, wherein a given cluster includes one or more speech sounds of the plurality of speech sounds that have given concatenation features that are related by a clustering metric; and based on a determination that the first speech sound has the given concatenation features represented in the given cluster, providing a representative speech sound of the given cluster as the first speech sound when the first speech sound and the second speech sound are concatenated.

2. The method of claim 1, further comprising:

determining, based on the given concatenation features of the one or more speech sounds in the given cluster, a space representation of the given cluster that includes one or more dimensions, wherein a given dimension corresponds to one of the given concatenation features;

determining, by the device, a centroid of the given cluster, wherein the centroid is indicative of mean values of the given concatenation features in the one or more dimensions; and identifying, from within the given cluster, the representative speech sound based on the representative speech sound having concatenation features with values that are at a minimum distance from the centroid compared to concatenation features of other speech sounds in the given cluster.

3. The method of claim 1, wherein the plurality of speech sounds is a first plurality of speech sounds, the method further comprising:

determining, by the device, a second plurality of speech sounds that includes representative speech sounds of the one or more clusters.

4. The method of claim 1, further comprising:

receiving, by the device, configuration input indicative of a reduction for the plurality of speech sounds; and determining, based on the reduction, a quantity of the one or more clusters.

5. The method of claim 1, wherein the concatenation features of the first speech sound include one or more of a last Fundamental Frequency value (F0), at least one frame of a spectral representation of a beginning portion of the first speech sound, or at least one frame of a spectral representation of an ending portion of the first speech sound.

6. The method of claim 5, wherein the first speech sound is indicative of a pronunciation of a diphone, wherein the concatenation features of the first speech sound include one or more of a duration of the pronunciation of a first half of the diphone, a duration of the pronunciation of a second half of the diphone, F0 of the pronunciation of the first half of the diphone, F0 of the pronunciation of a center portion of the diphone, or F0 of the pronunciation of the second half of the diphone.

7. The method of claim 6, further comprising:

receiving, by the device, configuration input indicative of a selection of the concatenation features to be included in the clustering.

8. The method of claim 1, wherein the clustering metric includes a centroid-based metric indicative of the given concatenation features in the given cluster having a given distance from a centroid of the given cluster that is less than a threshold distance, a distribution-based metric indicative of the given concatenation features being associated to a given statistical distribution, a density-based metric indicative of the given cluster including the one or more speech sounds such that the given cluster has a given density greater than a threshold density, or a connectivity-based metric indicative of the given concatenation features having a connectivity distance that is less than the threshold distance.

9. A non-transitory computer readable medium having stored therein instructions, that when executed by a device, cause the device to perform functions, the functions comprising:

receiving, at the device, a plurality of speech sounds that are each indicative of a different full pronunciation of a first linguistic term, wherein the first linguistic term includes a representation of one or more phonemes;

determining, by the device, concatenation features of the plurality of speech sounds of the first linguistic term, wherein the concatenation features are indicative of an acoustic transition between a first speech sound and a second speech sound when the first speech sound and the second speech sound are concatenated, wherein the first speech sound is included in the plurality of speech sounds of the first linguistic term and the second speech sound is indicative of a pronunciation of a second linguistic term;

clustering, based on the concatenation features, the plurality of speech sounds into one or more clusters, wherein a given cluster includes one or more speech sounds of the plurality of speech sounds that have given concatenation features that are related by a clustering metric; and based on a determination that the first speech sound has the given concatenation features represented in the given cluster, providing a representative speech sound of the given cluster as the first speech sound when the first speech sound and the second speech sound are concatenated.

10. The non-transitory computer readable medium of claim 9, the functions further comprising:

determining, based on the given concatenation features of the one or more speech sounds in the given cluster, a space representation of the given cluster that includes one or more dimensions, wherein a given dimension corresponds to one of the given concatenation features;

determining, by the device, a centroid of the given cluster, wherein the centroid is indicative of mean values of the given concatenation features in the one or more dimensions; and identifying, from within the given cluster, the representative speech sound based on the representative speech sound having concatenation features with values that are at a minimum distance from the centroid compared to concatenation features of other speech sounds in the given cluster.

11. The non-transitory computer readable medium of claim 9, wherein the plurality of speech sounds is a first plurality of speech sounds, the functions further comprising:

determining, by the device, a second plurality of speech sounds that includes representative speech sounds of the one or more clusters.

12. The non-transitory computer readable medium of claim 9, the functions further comprising:

receiving, by the device, configuration input indicative of a reduction for the plurality of speech sounds; and determining, based on the reduction, a quantity of the one or more clusters.

13. The non-transitory computer readable medium of claim 9, wherein the concatenation features of the first speech sound include one or more of a last Fundamental Frequency value (F0), at least one frame of a spectral representation of a beginning portion of the first speech sound, or at least one frame of a spectral representation of an ending portion of the first speech sound.

14. The non-transitory computer readable medium of claim 13, wherein the first speech sound is indicative of a pronunciation of a diphone, wherein the concatenation features of the first speech sound include one or more of a duration of the pronunciation of a first half of the diphone, a duration of the pronunciation of a second half of the diphone, F0 of the pronunciation of the first half of the diphone, F0 of the pronunciation of a center portion of the diphone, or F0 of the pronunciation of the second half of the diphone.

15. A device comprising:

one or more processors; and data storage configured to store instructions executable by the one or more processors to cause the device to:

receive a plurality of speech sounds that are each indicative of a different full pronunciation of a first linguistic term, wherein the first linguistic term includes a representation of one or more phonemes;

determine concatenation features of the plurality of speech sounds of the first linguistic term, wherein the concatenation features are indicative of an acoustic transition between a first speech sound and a second speech sound when the first speech sound and the second speech sound are concatenated, wherein the first speech sound is included in the plurality of speech sounds of the first linguistic term and the second speech sound is indicative of a pronunciation of a second linguistic term;

cluster, based on the concatenation features, the plurality of speech sounds into one or more clusters, wherein a given cluster includes one or more speech sounds of the plurality of speech sounds that have given concatenation features that are related by a clustering metric; and based on a determination that the first speech sound has the given concatenation features represented in the given cluster, provide a representative speech sound of the given cluster as the first speech sound when the first speech sound and the second speech sound are concatenated.

16. The device of claim 15, wherein the instructions executable by the one or more processors further cause the device to:

determine, based on the given concatenation features of the one or more speech sounds in the given cluster, a space representation of the given cluster that includes one or more dimensions, wherein a given dimension corresponds to one of the given concatenation features;

determine a centroid of the given cluster, wherein the centroid is indicative of mean values of the given concatenation features in the one or more dimensions; and identify, from within the given cluster, the representative speech sound based on the representative speech sound having concatenation features with values that are at a minimum distance from the centroid compared to concatenation features of other speech sounds in the given cluster.

17. The device of claim 15, wherein the plurality of speech sounds is a first plurality of speech sounds, wherein the instructions executable by the one or more processors further cause the device to:

determine a second plurality of speech sounds that includes representative speech sounds of the one or more clusters.

18. The device of claim 15, wherein the instructions executable by the one or more processors further cause the device to:

receive configuration input indicative of a reduction for the plurality of speech sounds; and determine, based on the reduction, a quantity of the one or more clusters.

19. The device of claim 15, wherein the concatenation features of the first speech sound include one or more of a last Fundamental Frequency value (F0), at least one frame of a spectral representation of a beginning portion of the first speech sound, or at least one frame of a spectral representation of an ending portion of the first speech sound.

20. The device of claim 19, wherein the first speech sound is indicative of a pronunciation of a diphone, wherein the concatenation features of the first speech sound include one or more of a duration of the pronunciation of a first half of the diphone, a duration of the pronunciation of a second half of the diphone, F0 of the pronunciation of the first half of the diphone, F0 of the pronunciation of a center portion of the diphone, or F0 of the pronunciation of the second half of the diphone.

* * * * *